US006361210B2

(12) United States Patent
Denko

(10) Patent No.: US 6,361,210 B2
(45) **Date of Patent: *Mar. 26, 2002**

(54) WATERPROOF CASE IN PARTICULAR TO SEA WATER OPENING BY MERE PRESSURE ON TWO OPPOSITE POINTS

(76) Inventor: Jacques Denko, Residence les Cigalons, 19 avenue des Coccinelles, 13012 Marseille (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/367,872

(22) PCT Filed: Mar. 3, 1998

(86) PCT No.: PCT/FR98/00414

§ 371 Date: Sep. 3, 1999

§ 102(e) Date: Sep. 3, 1999

(87) PCT Pub. No.: WO98/38887

PCT Pub. Date: Sep. 11, 1998

(30) Foreign Application Priority Data

Mar. 6, 1997 (FR) ..... 97/02891
Feb. 10, 1998 (FR) ..... 98/01799

(51) Int. Cl.[7] ..... B65D 33/00

(52) U.S. Cl. ..... 383/35; 150/150; 150/900; 206/811; 383/463; 383/113

(58) Field of Search ..... 224/610, 674, 224/235; 206/811; 150/150, 900; 383/35, 113, 59, 60, 63, 43, 68, 81; 220/281; 24/585.12; 251/4, 7

(56) References Cited

U.S. PATENT DOCUMENTS 1,658,294 A * 2/1928 Lewis ..... 150/150
1,671,385 A * 5/1928 Strayer
1,683,603 A * 9/1928 Canfiled ..... 206/811 X
1,887,940 A * 11/1932 Marinsky ..... 383/43
2,039,887 A * 5/1936 Colletti ..... 224/235 X
2,107,216 A * 1/1938 Rogers ..... 383/113 X
2,236,024 A * 3/1941 Tyler ..... 383/113 X
2,717,014 A * 9/1955 Corn ..... 383/113 X
2,868,254 A * 1/1959 Saad ..... 150/150 X
3,110,335 A * 11/1963 Antonius ..... 383/43
3,160,186 A * 12/1964 Conley ..... 150/150 X
3,272,248 A * 9/1966 O'Farrell ..... 150/150 X
4,733,807 A * 3/1988 Porter et al. ..... 224/610 X
D308,128 S * 5/1990 Paquette ..... 224/235 X
5,069,261 A * 12/1991 Ji ..... 150/150
5,174,658 A * 12/1992 Cook et al. ..... 150/900 X
5,244,136 A * 9/1993 Collaso ..... 224/235 X
5,472,281 A * 12/1995 Phelps ..... 383/43
5,511,390 A * 4/1996 Mah ..... 206/811 X
5,623,980 A * 4/1997 McMahon ..... 383/43 X
6,022,144 A * 2/2000 Husslein ..... 383/43 X

FOREIGN PATENT DOCUMENTS

DE 269.907 * 2/1914 ..... 251/4
DE 2527695 * 12/1969 ..... 383/35
FR 2005025 * 12/1969
GB 23507 * 1/1898 ..... 251/4
GB 2209928 * 6/1989

* cited by examiner

*Primary Examiner*—Stephen P. Garbe
*Assistant Examiner*—Robin A. Hylton
(74) *Attorney, Agent, or Firm*—Greenblum & Bernstein, P.L.C.

(57) ABSTRACT

A waterproof case which seals out sea water and opens upon the application of pressure on two opposite points. The case has a flattened wallet shape and is made from a single piece of synthetic material. The case has two opening edges with at least one opening edge having a compressible strip. The case is absolutely waterproof in a static state until pressure is applied to the edges of the case which forces the opening edges to separate from one another. The case is useful for protecting various objects, such as coins, bank notes, keys, identity papers again water, perspiration, sand, dust and similar objects.

17 Claims, 2 Drawing Sheets

WATERPROOF CASE IN PARTICULAR TO SEA WATER OPENING BY MERE PRESSURE ON TWO OPPOSITE POINTS

BACKGROUND OF THE INVENTION

1. Field of the Invention

The object of the present invention is a waterproof case, in particular to sea water, opening by mere pressure on two opposite points.

It has the object of protecting various objects, such as coins, bank notes, keys, identity papers against water, perspiration, sand, dust, and the like.

It is adapted in particular for swimmers and allows them to keep their objects of value on them while they engage in nautical activities, such as swimming, diving, windsurfing, or others.

2. Description of Background and Relevant Information

A certain number of devices adapted to protect objects against sea water currently exist. In particular, belts comprising one or a plurality of waterproof compartments are known, but they are relatively expensive and cumbersome systems, use of which can become generalized only with difficulty.

French Patents No. 2 513 864 and 2 517 183, filed by the Applicant, refer to a flattened flexible waterproof case comprising on one of its faces a cutout into which a rigid cover fits due to a groove arranged either on periphery of this cutout, or on the periphery of the cover.

The necessity of having to insert the cover into the groove of the case, or the edges of the cutout into that of the cover makes the operations of opening and closing difficult, and the cover may be lost.

Moreover, since this type of device is adapted especially for use on the beach, there is a risk of grains of sand becoming lodged in the grooves, compromising the waterproofness of the unit.

SUMMARY OF THE INVENTION

The object of the device according to present invention is to overcome this situation by enabling the realization of an absolutely waterproof case with a relatively low manufacturing cost which may be placed in the pocket, hung around the neck, or attached to any clothing base, to enable the user not to be separated from his money or papers while swimming.

It is constituted of a flattened wallet made preferably in one single piece of synthetic material, and including on the inner face of the opening edges at least one compressible bonded or sealed joint pressed against the second joint or against the opposite edge so as to make the wallet absolutely waterproof when no pressure is exerted on it, the walls of the device being arranged such that pressure on the side ends of these edges causes them to move apart permitting access inside the device.

The invention also provides for a waterproof case which opens by mere pressure on two opposite points, comprising an enclosure for holding and protecting various objects. The case is resistant to the introduction of foreign matter. At least two walls having first and second opening edges are provided. A compressible first joint strip is affixed to the first opening edge. A compressible second joint strip is affixed to the second opening edge. Each of the first and second joint strips comprise a sealing recess. The sealing recesses are arranged directly opposite one another. Each of the first and second joint strips are affixed to an inner face of one of the opening edges for producing a sealed joint. The case is absolutely water proof when the first joint strip is pressed against the second joint strip and when no pressure is exerted on the case. The sealed joint produces a sucking effect between the first and second opening edges.

The sealed joint prevents the passage of sea water and is adapted for use by swimmers. The various objects comprise at least one of coins, bank notes, keys, and identity papers. The foreign matter comprises at least one of water, perspiration, sand and dust. The opening edges comprise side ends and wherein the sealed joint is broken when pressure is applied to the side ends causing the opening edges to move apart and thereby providing access inside the case. The enclosure may comprise a single piece of a sea water resistant material. The enclosure may comprise a synthetic material. The enclosure is one of injection molded and thermoformed by blowing. The opening edges comprise a thickness that is greater than a thickness of the at least two walls. The case further comprises at least two steel strips, wherein at least one steel strip is disposed between one opening edge and the sealed joint. Each opening edge comprises a steel strip which statically biases the opening edges towards one another so as to produce a seal between the opening edges. The joint strip comprises an elastomer foam which is affixed by one of adhesive and heat sealing. The case further comprises at least one belt engaging loop provided on a surface of at least one of the walls. The case further comprises at least one eyelet for engaging one of a cord and a chain, the at least one eyelet being adjacent an end of at least one of the walls. The case farther comprises a locking system for interlocking the opening edges.

The invention further contemplates a waterproof case which opens by mere pressure on two opposite points, comprising an enclosure for holding and protecting various objects. The case is resistant to the introduction of one of foreign matter. At least a first wall and a second wall are included. The first wall has a first opening edge and the second wall has a second opening edge. The first and second opening edges defining a sealed joint. A first joint strip is affixed to the first opening edge and has at least one engaging recess. A steel strip is disposed on the first opening edge. A second joint strip is affixed to the second opening edge and has at least one engaging recess. A steel strip is disposed on the second opening edge. Each of the engaging recesses is arranged directly opposite one another. The enclosure is normally biased to a closed sealed state with the first joint strip contacting the second joint strip. The enclosure becomes open and unsealed when the first and second steel strips experience a compressive force. The sealed joint produces a sucking effect between the first and second opening edges.

The first and second steel strips are each disposed between the first and second joint strips and the corresponding first and second opening edges. The case comprises a substantially rectangular shape with three closed sides and one open side.

The invention is also directed to a waterproof case which opens by mere pressure on two opposite points, comprising an enclosure for holding and protecting various objects. The enclosure is resistant to the introduction of one of foreign matter. At least a first wall and a second wall is included. The first wall has a first opening edge and the second wall has a second opening edge. The first and second opening edges define a sealed joint. A first joint strip is affixed to the first opening edge and has at least one engaging recess. A first steel strip is disposed on the first opening edge between the first joint strip and the first opening edge. A second joint strip is affixed to the second opening edge and has at least one engaging recess. A second steel strip is disposed on the second opening edge between the second joint strip and the second opening edge. Each of the first and second sealing recesses are arranged directly opposite one another. The enclosure is normally biased to a closed sealed state with the first joint strip contacting the second joint strip. The enclosure becomes open and unsealed when the first and second steel strips are deflected away from one another. The sealed joint produces a sucking effect between the first and second opening edges.

BRIEF DESCRIPTION OF THE DRAWINGS

In the attached drawings, provided by way of nonrestrictive examples of embodiments of the object of the invention.

DETAILED DESCRIPTION OF THE INVENTION

The device, as shown in FIGS. 1 through 7, is constituted of a case 1 forming a flattened wallet and having a generally rectangular shape, and closed on three sides 2, 3, 4. The edges 5, 6 of the fourth side can be brought together to ensure a waterproof closing or moved apart to enable filling or emptying the wallet.

Figure 1:
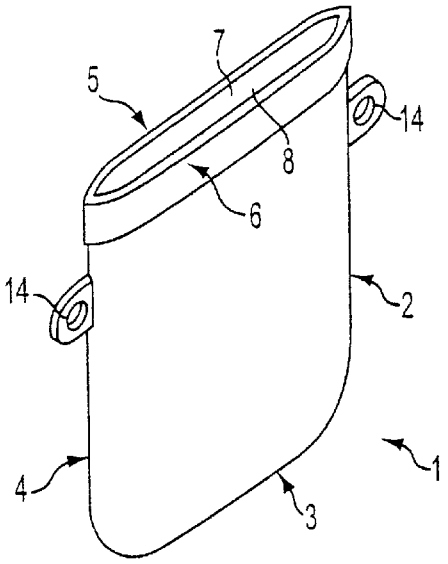
FIGS. 1 and 2 show the open and closed case respectively in axonometric projection.
Figure 2:
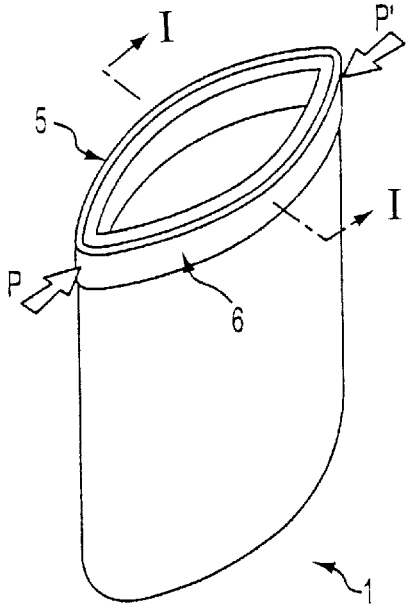

The case 1 can be made of a semi-rigid or a flexible material and is arranged such that the edges 5, 6 press against each other when no force is exerted (FIG. 1). However, when pressure applied according to the arrows P—P' on the side ends of these edges causing their deformation is caused in a circular arch and thereby causes sufficient spreading to enable access to the contents of the device (FIG. 2).

The case 1 is preferably made in one single piece of a sea water resistant material which can be, such as a synthetic material injection molded or thermoformed by blowing. The case 1 can also be produced by any other technique making it possible to obtain the same result.

At least one of the inner faces of the edges 5, 6 of the fourth side is covered by a compressible joint 7, 8 made, for example, of an elastomer foam. The joint ensures such that the case is absolutely waterproof at rest, when no pressure is exerted on the side ends of the edges.

Figure 4:
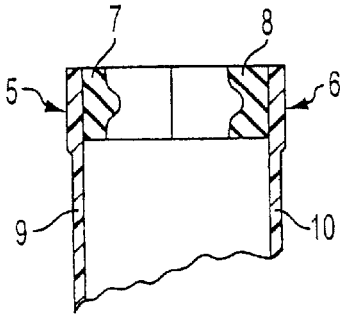
FIG. 4 shows a partial enlarged cross-section depicting a case comprising longitudinally grooved waterproof joints.

The joint or joints 7, 8 can be affixed to edges 5, 6 by gluing, or by heat sealing at the time of fabrication of the case 1. They can have either a rectangular section or a longitudinally grooved inner surface, which can improve the waterproofness of the system (FIG. 4).

In order to have sufficient rigidity to guarantee the waterproofness of the unit, the edges 5, 6 may advantageously have a greater thickness than that of the walls 9, 10 of the case 1.

Figure 5:
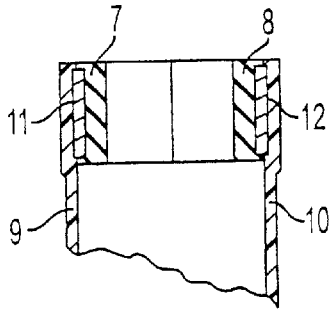
FIG. 5 shows under the same conditions, a case equipped with steel strips adapted to increase the closing pressure.
Figure 6:
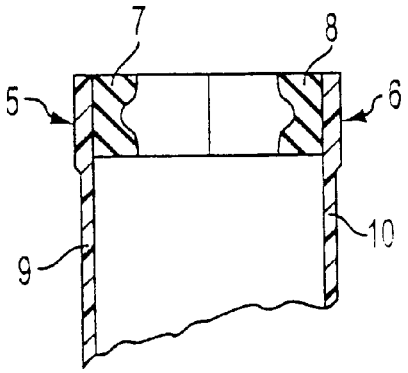
FIG. 6 shows a partial enlarged cross-section showing a case comprising waterproof joints according to a geometry adapted to produce a sucking effect between the two opening edges.

According to a variant embodiment, the closing force is obtained due to steel strips 11, 12 which are incorporated into the walls 9, 10 of the case 1. Steel strips 11, 12 may be disposed for example, between walls 9, 10 and the waterproof joints 7, 8. This arrangement enables using a flexible material for the fabrication of the case (FIG. 5).

Figure 3:
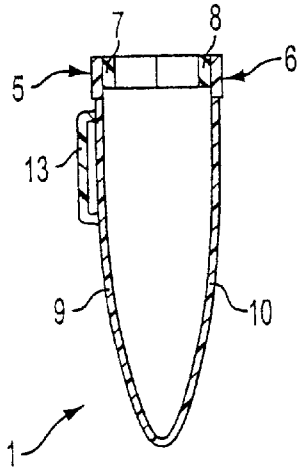
FIG. 3 shows a vertical transverse cross-section along the arrows A—A' of FIG. 2.

A loop 13, through which a belt can pass in order to affix the case at the waist, may be provided on one of the outer surfaces of the case (FIG. 3). Similarly, the sides of the case 1 may also include eyelets 14 capable of accommodating a cord or a chain which can run around the neck or enabling hanging the case 1 (FIG. 1).

Figure 7:
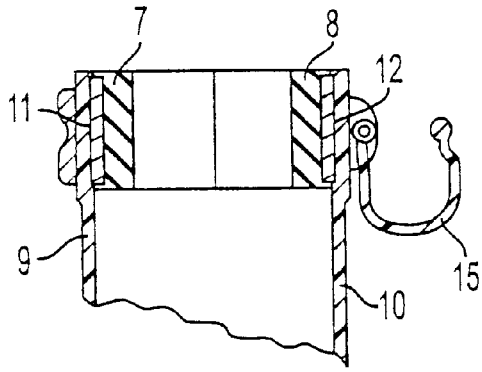
FIG. 7 shows a partial enlarged cross-section showing a case comprising a locking system adapted to interlock the two opening edges.

According to another embodiment, the force for maintaining the closing is obtained due to the use of a locking system 15, which serves to interlock the two opening edges of the case 1 (FIG. 7).

Due to its simplicity, its ease-of-use, and its low cost, the device just described lends itself particularly well to achieving a wallet or a card-holder which may be used in all places and under all circumstances, and in particular on the beach.

The positioning of the various constituent elements gives the object of the invention a maximum of useful effects which have not been previously obtained by similar devices.

What is claimed is:

1. A waterproof case which opens by mere pressure on two opposite points, comprising:

an enclosure for holding and protecting various objects, said case being resistant to the introduction of foreign matter;

at least two walls having first and second opening edges;

a compressible first joint strip affixed to the first opening edge;

a compressible second joint strip affixed to the second opening edge;

each of the first and second joint strips comprising a sealing recess wherein the sealing recesses are arranged directly opposite one another;

each of the first and second joint strips being affixed to an inner face of one of the opening edges for producing a sealed joint;

wherein the case is absolutely water proof when the first joint strip is pressed against the second joint strip when no pressure is exerted on the case, and wherein the sealed joint has a geometry adapted to produce a sucking effect between the first and second opening edges.

2. The case of claim 1, wherein the sealed joint prevents the passage of sea water and is adapted for use by swimmers, wherein the various objects comprise at least one of coins, bank notes, keys, and identity papers, and wherein the foreign matter comprises at least one of water, perspiration, sand and dust.

3. The case of claim 1, wherein the opening edges comprise side ends and wherein the sealed joint is broken when pressure is applied to the side ends causing the opening edges to move apart and thereby providing access inside the case.

4. The case of claim 1, wherein the enclosure comprises a single piece of a sea water resistant material.

5. The case of claim 4, wherein the enclosure comprises a synthetic material.

6. The case of claim 5, wherein the enclosure is one of injection molded and thermoformed by blowing.

7. The case of claim 1, wherein the opening edges comprise a thickness that is greater than a thickness of the at least two walls.

8. The case of claim 1, further comprising:

at least two steel strips, wherein at least one steel strip is disposed between one opening edge and the sealed joint.

9. The case of claim 1, wherein each opening edge comprises a steel strip which statically biases the opening edges towards one another so as to produce a seal between the opening edges.

10. The case of claim 1, wherein the joint strip comprises an elastomer foam which is affixed by one of adhesive and heat sealing.

11. The case of claim 1, further comprising at least one belt engaging loop provided on a surface of at least one of the walls.

12. The case of claim 1, further comprising at least one eyelet for engaging one of a cord and a chain, the at least one eyelet being adjacent an end of at least one of the walls.

13. The case of claim 1, further comprising a locking system for interlocking the opening edges.

14. A waterproof case which opens by mere pressure on two opposite points, comprising:

an enclosure for holding and protecting various objects, said case being resistant to the introduction of foreign matter;

at least a first wall and a second wall, said first wall having a first opening edge and said second wall having a second opening edge, the first and second opening edges defining a sealed joint;

a first joint strip affixed to the first opening edge and having at least one engaging recess;

a steel strip disposed on the first opening edge;

a second joint strip affixed to the second opening edge and having at least one engaging recess; and a steel strip disposed on the second opening edge, each of the engaging recesses being arranged directly opposite one another;

wherein the enclosure is normally biased to a closed sealed state with the first joint strip contacting the second joint strip, wherein the enclosure becomes open and unsealed when the first and second steel strips experience a compressive force, and wherein the sealed joint has a geometry adapted to produce a sucking effect between the first and second opening edges.

15. The case of claim 14, wherein the first and second steel strips are each disposed between the first and second joint strips and the corresponding first and second opening edges.

16. The case of claim 15, wherein the case comprises a substantially rectangular shape with three closed sides and one open side.

17. A waterproof case which opens by mere pressure on two opposite points, comprising:

an enclosure for holding and protecting various objects, said enclosure being resistant to the introduction of foreign matter;

at least a first wall and a second wall, said first wall having a first opening edge and said second wall having a second opening edge, the first and second opening edges defining a sealed joint;

a first joint strip affixed to the first opening edge and having at least one engaging recess;

a first steel strip disposed on the first opening edge between the first joint strip and the first opening edge;

a second joint strip affixed to the second opening edge and having at least one engaging recess;

a second steel strip disposed on the second opening edge between the second joint strip and the second opening edge;

each of the first and second sealing recesses being arranged directly opposite one another;

the enclosure being normally biased to a closed sealed state with the first joint strip contacting the second joint strip, wherein the enclosure becomes open and unsealed when the first and second steel strips are deflected away from one another, and wherein the sealed joint has a geometry adapted to produce a sucking effect between the first and second opening edges.

* * * * *